US010208639B2

(12) United States Patent
Lee et al.

(10) Patent No.: US 10,208,639 B2
(45) Date of Patent: Feb. 19, 2019

(54) STRUCTURE OF MUFFLER

(71) Applicants: Hyundai Motor Company, Seoul (KR); Sejong Ind. Co., Ltd., Ulsan (KR)

(72) Inventors: Ju-Hyuck Lee, Pohang-si (KR); Hong-Jae Kim, Hwaseong-si (KR); Ki-Chul Park, Suwon-si (KR); In-Sung Jung, Suwon-si (KR); Seung-Hoon Chae, Ulsan (KR)

(73) Assignees: Hyundai Motor Company, Seoul (KR); Sejong Ind. Co., Ltd., Ulsan (KR)

( * ) Notice: Subject to any disclaimer, the term of this patent is extended or adjusted under 35 U.S.C. 154(b) by 33 days.

(21) Appl. No.: 15/367,025

(22) Filed: Dec. 1, 2016

(65) Prior Publication Data

US 2018/0051608 A1 Feb. 22, 2018

(30) Foreign Application Priority Data

Aug. 18, 2016 (KR) ..... 10-2016-0104655

(51) Int. Cl.
*F01N 1/08* (2006.01)
*F01N 1/04* (2006.01)
(Continued)

(52) U.S. Cl.
CPC ..... *F01N 1/083* (2013.01); *F01N 1/006* (2013.01); *F01N 1/026* (2013.01); *F01N 1/24* (2013.01);
(Continued)

(58) Field of Classification Search
CPC ..... F01N 1/003; F01N 1/006; F01N 1/026; F01N 1/04; F01N 1/089; F01N 1/10;
(Continued)

(56) References Cited

U.S. PATENT DOCUMENTS 706,844 A * 8/1902 Motsinger ..... F01N 1/08 181/239
2,520,756 A * 8/1950 Bryant ..... F01N 1/003 181/232
(Continued)

FOREIGN PATENT DOCUMENTS

DE 3837677 A1 * 6/1989 ..... F01N 1/02
KR 10-0962791 B1 6/2010
(Continued)

*Primary Examiner* — Edgardo San Martin
(74) *Attorney, Agent, or Firm* — Morgan, Lewis & Bockius LLP

(57) ABSTRACT

A structure pof muffler may include a housing which has a space therein, and has a first side connected to an inlet pipe into which exhaust gas flows, a first baffle which divides an interior of the housing into a front chamber and an intermediate chamber connected to the inlet pipe, a second baffle which divides the interior of the housing into a rear chamber and the intermediate chamber connected to the inlet pipe, and a discharge pipe which is mounted to penetrate the first baffle and the second baffle, and mounted such that a first end of the discharge pipe is positioned in the rear chamber, and a second end of the discharge pipe extends through the front chamber and penetrates the housing.

11 Claims, 5 Drawing Sheets

(51) Int. Cl.

| | |
|---|---|
| ***F01N 1/24*** | (2006.01) |
| ***G10K 11/16*** | (2006.01) |
| ***F01N 1/00*** | (2006.01) |
| ***F01N 1/02*** | (2006.01) |
| ***G10K 11/172*** | (2006.01) |

(52) U.S. Cl.
CPC ..... *G10K 11/161* (2013.01); *G10K 11/172* (2013.01); *F01N 2470/02* (2013.01); *F01N 2470/18* (2013.01)

(58) Field of Classification Search
CPC .... F01N 1/24; F01N 2470/14; F01N 2470/18; F01N 2490/02; F01N 2490/04; F01N 2490/06; F01N 2490/08
See application file for complete search history.

(56) References Cited

U.S. PATENT DOCUMENTS 3,454,129 A * 7/1969 Everett ..... F01N 1/24 181/268
4,105,089 A * 8/1978 Judd ..... F01D 25/30 181/256
5,025,890 A * 6/1991 Hisashige ..... F01N 1/02 181/256
6,241,044 B1 * 6/2001 Nishiyama ..... F01N 1/083 181/227
6,382,347 B1 * 5/2002 Gerber ..... F01N 1/04 181/212
6,959,782 B2 * 11/2005 Brower ..... F01N 1/02 181/238
7,681,690 B2 * 3/2010 Roberts ..... B25D 17/12 181/230
8,051,949 B2 * 11/2011 Henke ..... F01N 1/08 181/212
8,205,713 B2 * 6/2012 Gorke ..... F01N 13/1838 181/212
8,205,716 B2 * 6/2012 Wirth ..... F01N 1/08 181/212
8,579,077 B2 * 11/2013 Ahn ..... F01N 13/08 181/212
8,684,131 B1 * 4/2014 Park ..... F01N 1/04 181/228
9,133,753 B2 * 9/2015 Vollmer ..... F01N 1/003
2002/0033302 A1 * 3/2002 Kaneko ..... F01N 1/089 181/232
2005/0224283 A1 * 10/2005 Yokoi ..... F01N 1/06 181/268
2007/0125594 A1 * 6/2007 Hill ..... F01N 1/084 181/256
2009/0000863 A1 * 1/2009 Kuo ..... F01N 1/089 181/256

FOREIGN PATENT DOCUMENTS

KR 10-1237931 B1 2/2013
KR 10-2014-0080644 A 7/2014

* cited by examiner

STRUCTURE OF MUFFLER

CROSS-REFERENCE TO RELATED APPLICATIONS

The present application claims priority to Korean Patent Application No. 10-2016-0104655, filed on Aug. 18, 2016, the entire contents of which is incorporated herein for all purposes by this reference.

BACKGROUND OF THE INVENTION

Field of the Invention

The present invention relates to a structure of a muffler which reduces exhaust noise of exhaust gas, and more particularly, to a structure of a muffler for a vehicle, which is capable of improving output by reducing back pressure, and capable of generating more sporty exhaust sound by emphasizing a middle to low frequency sound while suppressing high frequency sound.

Description of Related Art

An exhaust system mounted in a vehicle is an apparatus which discharges exhaust gas generated in an engine to the outside, and reduces exhaust noise.

A typical exhaust system for a vehicle includes an exhaust manifold which is connected to cylinders in an engine, a catalyst converter (1 in FIG. 1) which converts hazardous substances in exhaust gas by using catalysts, a muffler (main silencer) (4 in FIG. 1) which has an interior divided by a plurality of baffles so as to induce expansion of exhaust gas, and thus reduces exhaust sound by using reflection or resonance of acoustic waves, a sub-silencer (2 in FIG. 1) which serves to assist the muffler in order to improve resonance properties of an exhaust noise system, and end pipes (3 in FIG. 1) which extend from the muffler and finally discharge exhaust gas.

Among the above components, the muffler is configured such that a plurality of pipes and the plurality of baffles are mounted in a housing formed in a cylindrical shape having a predetermined size so as to reduce exhaust noise by inducing expansion of exhaust gas, resonance, and absorbing noise when exhaust gas flows.

Meanwhile, the shape and the disposition structure of the muffler vary in accordance with the number and the disposition structure of the end pipes which extend from the muffler and discharge exhaust gas to the outside.

A transverse structure (in which the muffler is disposed in a vehicle width direction), among various disposition structures of the muffler, is configured as illustrated in FIG. 1 in order to implement sporty sound and solve a problem of thermal damage. That is, in a structure in the related art, an interior of a housing 5 is divided into first to fifth chambers 6*a*, 6*b*, 6*c*, 6*d*, and 6*e* by four baffles 5*a*, an inlet pipe 8 through which exhaust gas flows in is connected to the third chamber 6*c*, a first pipe 9*a* is positioned to penetrate the baffles 5*a* so that both ends of the first pipe 9*a* are positioned in the third chamber 6*c* and the fifth chamber 6*e*, respectively, and a second pipe 9*b* is mounted such that one side end of the second pipe 9*b* is positioned in the fifth chamber 6*e* and the other side end of the second pipe 9*b* extends to the end pipes 3 outside the housing 5. Further, exhaust gas discharged from the inlet pipe 8 flows into the fifth chamber 6*e* through the first pipe 9*a* and then is discharged to the outside of the housing 5 from the fifth chamber 6*e* through the second pipe 9*b*. Further, acoustic absorbents are disposed in the first chamber 6*a*, the second chamber 6*b*, and the fourth chamber 6*d*, respectively, and through holes through which exhaust gas flows in and out are formed in the first pipe 9*a* and the second pipe 9*b* at the points with which the acoustic absorbents are in direct contact, such that exhaust noise is reduced while exhaust gas is discharged to the outside.

However, in the case of the structure in the related art, there are problems in that the structure is disadvantageous when implementing a sporty sound and back pressure is set to be high.

That is, in general, in order to implement an optimum sporty sound, it is important to maximally reduce high frequency noise which is rough to hear, and to appropriately maintain a rumble sound within a low or middle frequency region. However, in the case of the structure in the related art, exhaust gas flows into the third chamber 6*c* and then is discharged through the fifth chamber 6*e* (a flow path of exhaust gas is lengthened), and as a result, the structure in the related art cannot increase noise in a particular RPM band but is suitable to reduce overall noise. In addition, because a vehicle, which requires a sporty tone, also requires high engine performance, it is essential to reduce back pressure in order to satisfy engine performance. However, in a single tip structure (which is configured such that a single pipe extends outward from the muffler housing as illustrated in FIG. 1), the amount of exhaust gas that can be discharged is restricted, and as a result, there is a problem in that it is difficult to reduce back pressure and satisfy engine performance.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a structure of a muffler capable of reducing back pressure by reducing flow resistance when discharging exhaust gas, and capable of making it easy to tune exhaust sound in a middle to low frequency band (200 to 400 Hz) which has an effect on generation of a sporty exhaust sound.

An exemplary embodiment of the present invention provides a structure of a muffler, including: a housing which has a space therein, and has one side connected to an inlet pipe into which exhaust gas flows; a first baffle which divides an interior of the housing into a front chamber and an intermediate chamber connected to the inlet pipe; a second baffle which divides the interior of the housing into a rear chamber and the intermediate chamber connected to the inlet pipe; and a discharge pipe which is mounted to penetrate the first baffle and the second baffle, and mounted such that one end of the discharge pipe is positioned in the rear chamber, and the other end of the discharge pipe extends through the front chamber and penetrates the housing, in which at least one of the front chamber and the rear chamber is filled with an acoustic absorbent, inlet holes into which exhaust gas flows are formed in the discharge pipe in a section where the discharge pipe is positioned in the intermediate chamber, and through holes through which exhaust gas flows in and out are formed in the discharge pipe in a section where the discharge pipe is positioned in the front chamber and a section where the discharge pipe is positioned in the rear chamber.

Two discharge pipes may be disposed in parallel, and the discharge pipe may be mounted such that a length of a section where the discharge pipe is positioned in the front chamber is longer than a length of a section where the discharge pipe is positioned in the rear chamber.

In the exemplary embodiment of the present invention, the acoustic absorbent may be glass wool.

The number of communication holes formed in the first baffle may be larger than the number of communication holes formed in the second baffle, and the other end of the discharge pipe, which is positioned in the rear chamber, may be blocked by a cap.

A third baffle, which divides the front chamber into a first chamber and a second chamber, may be additionally mounted, and the through holes may be formed at positions where the discharge pipe communicates with the first chamber and the second chamber.

A fourth baffle, which divides the rear chamber into a third chamber and a fourth chamber, may be additionally mounted, and the through holes may be formed at positions where the discharge pipe communicates with the third chamber and the fourth chamber.

In the exemplary embodiment of the present invention, the through holes may have a smaller inner diameter than the inlet hole, and the through holes may be formed to have a uniform size around the discharge pipe.

The housing may be formed to have a polyhedral shape having two relatively longer sides and two relatively shorter sides, the inlet pipe may be configured to penetrate one of the relatively longer sides in a direction perpendicular to the relatively longer side, and the discharge pipe may be configured to penetrate one of the relatively shorter sides in a direction perpendicular to the relatively shorter side.

The present invention having the aforementioned configuration is set such that the occurrence of high frequency booming noise may be reduced (by the embedded acoustic absorbent) and frequencies in a middle to low band are increased (by the effect of resonance in air column caused by the increased flow path of exhaust gas), and as a result, it is possible to implement a more sporty exhaust sound.

In the present invention, the two discharge pipes are disposed in parallel, and as a result, the present invention is advantageous in that flow resistance of exhaust gas is reduced and back pressure is reduced. Further, the front chamber and the rear chamber, except for the intermediate chamber, are filled with glass wool which is the acoustic absorbent, and the glass wool provides a heat radiating function, and as a result, it is possible to prevent thermal damage to components at the periphery of the muffler.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
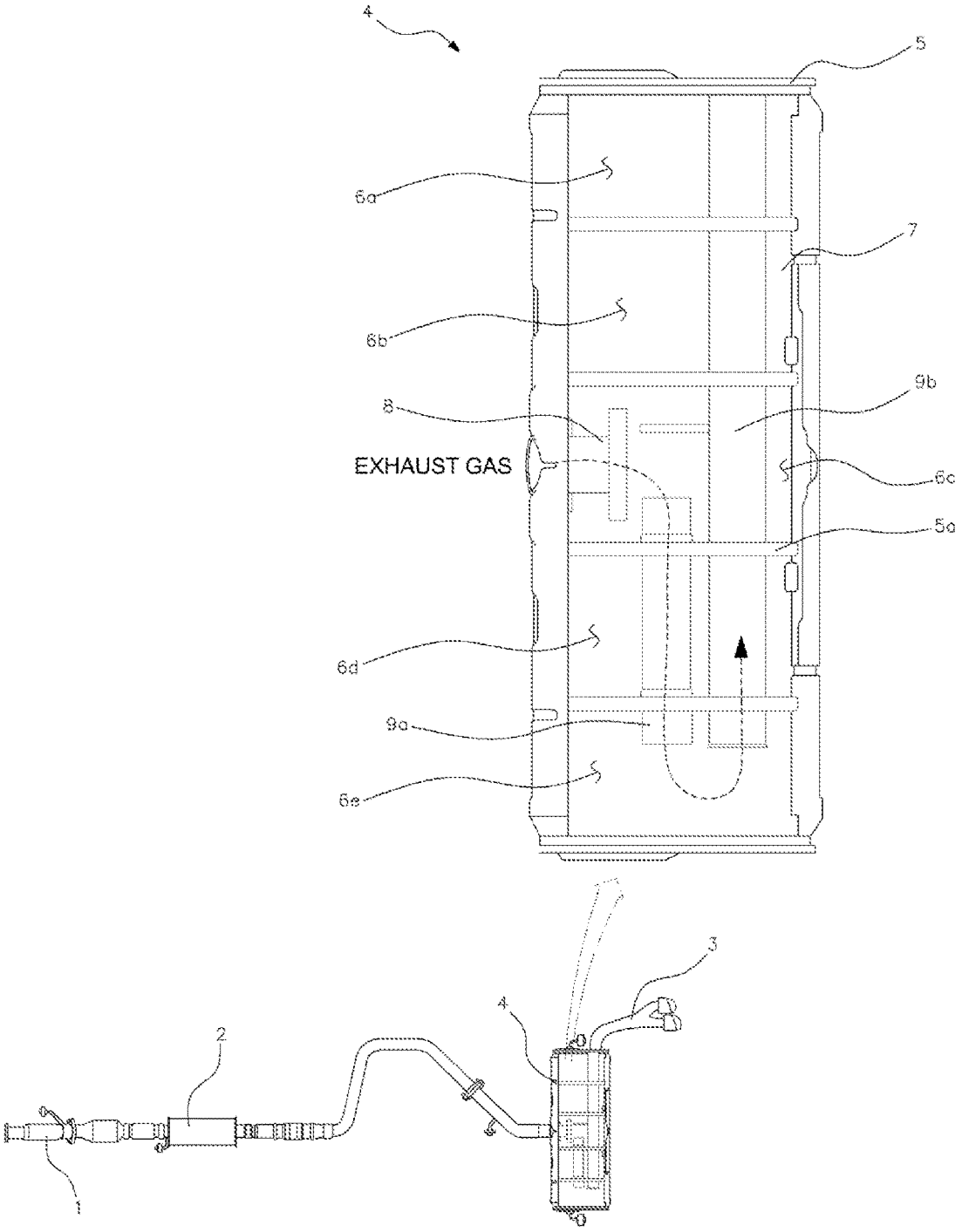
FIG. 1 (Prior art)
FIG. 1 is a view of a structure of a muffler in the related art, in which the structure of the muffler is penetrated to show an interior of the structure of the muffler.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

A part irrelevant to the description will be omitted to clearly describe the present invention, and the same or similar constituent elements will be designated by the same reference numerals throughout the specification.

In addition, terms or words used in the specification and the claims should not be interpreted as being limited to a general or dictionary meaning and should be interpreted as a meaning and a concept which conform to the technical spirit of the present invention based on a principle that an inventor can appropriately define a concept of a term in order to describe his/her own invention by the best method.

The present invention relates to a muffler for a vehicle, and hereinafter, an exemplary embodiment of the present invention will be described in more detail with reference to the drawings.

Figure 2:
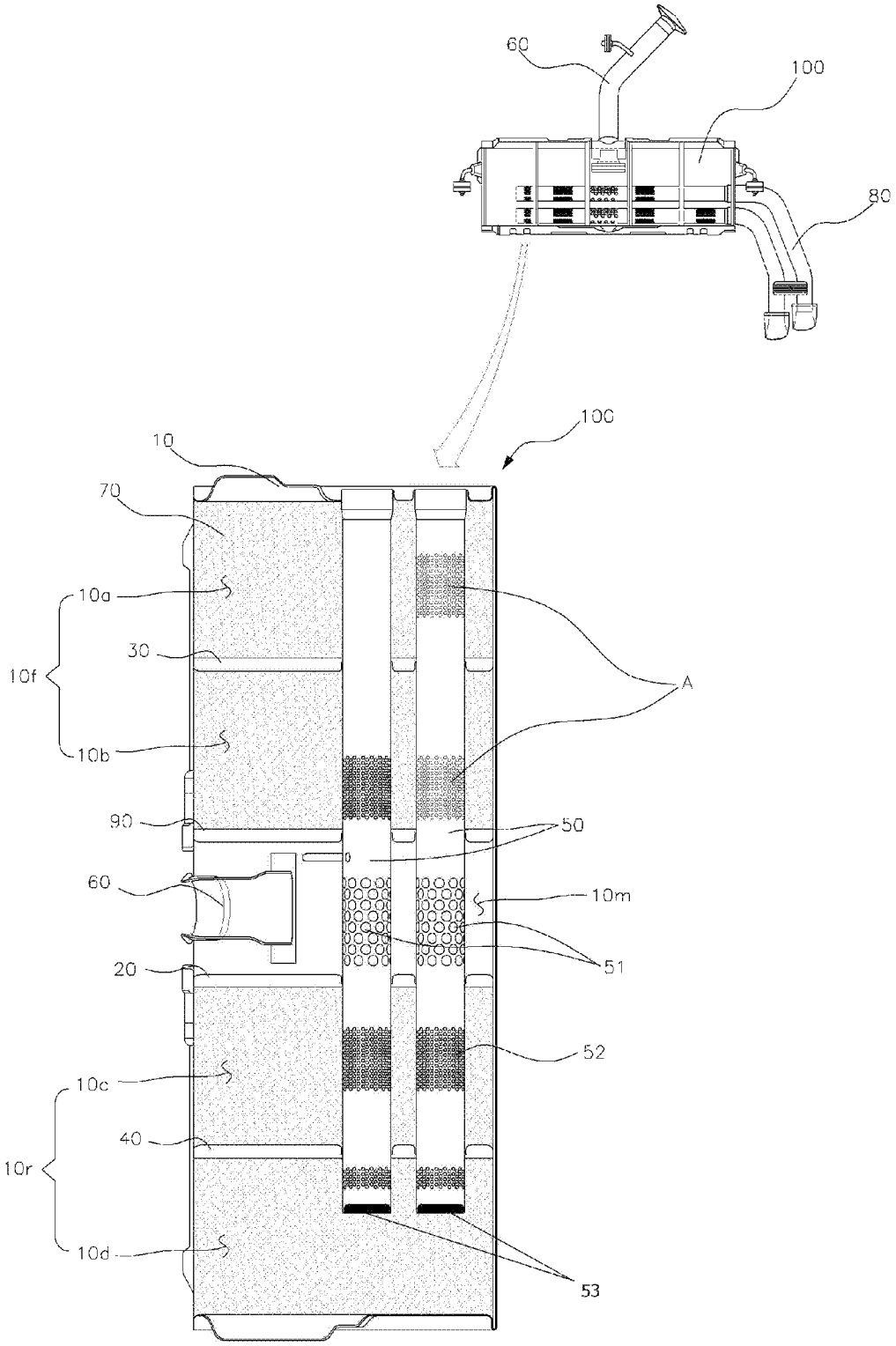
FIG. 2 is a view of a muffler according to an exemplary embodiment of the present invention, in which the muffler is penetrated to show an interior of the muffler.

Referring to FIG. 2, a housing 10 of a muffler 100 is provided with a space therein, and formed to have a polyhedral shape (hexahedral or cylindrical shape) having two relatively longer sides and two relatively shorter sides. An inlet pipe 60 into which exhaust gas flows is connected to one side of the housing 10, and end pipes 80, which are continuously formed from discharge pipes 50 so as to discharge exhaust gas, are connected to the other side of the housing 10. The inlet pipe 60 penetrates one of the relatively longer sides in a direction perpendicular to the relatively longer side, and the discharge pipes 50 penetrate one of the relatively shorter sides in a direction perpendicular to the relatively shorter side.

A first baffle 90 and a second baffle 20 are mounted in the housing 10 so as to divide the space in the housing 10, and thus the interior of the housing 10 is divided into a front chamber 10*f* (formed relatively close to the end pipe), an intermediate chamber 10*m*, and a rear chamber 10*r* (formed relatively distant from the end pipe). That is, the interior of the housing 10 is divided into the front chamber 10*f* and the intermediate chamber 60 connected to the inlet pipe 60 by the first baffle 90, and the intermediate chamber 10*m* and the rear chamber 10*r* by the second baffle 20.

The two discharge pipes 50 are mounted in the housing 10 so as to penetrate the first baffle 90 and the second baffle 20, and one end of the discharge pipe 50 is positioned in the rear chamber 10*r*, and the other end of the discharge pipe 50 extends through the front chamber 10*f* so as to penetrate the housing 10 and communicate with the end pipe 80. Further, in the exemplary embodiment of the present invention, the discharge pipe 50 is mounted such that a length of a section where the discharge pipe 50 is positioned in the front chamber 10*f* is longer than a length of a section where the discharge pipe 50 is positioned in the rear chamber 10*r*.

Figure 3A:
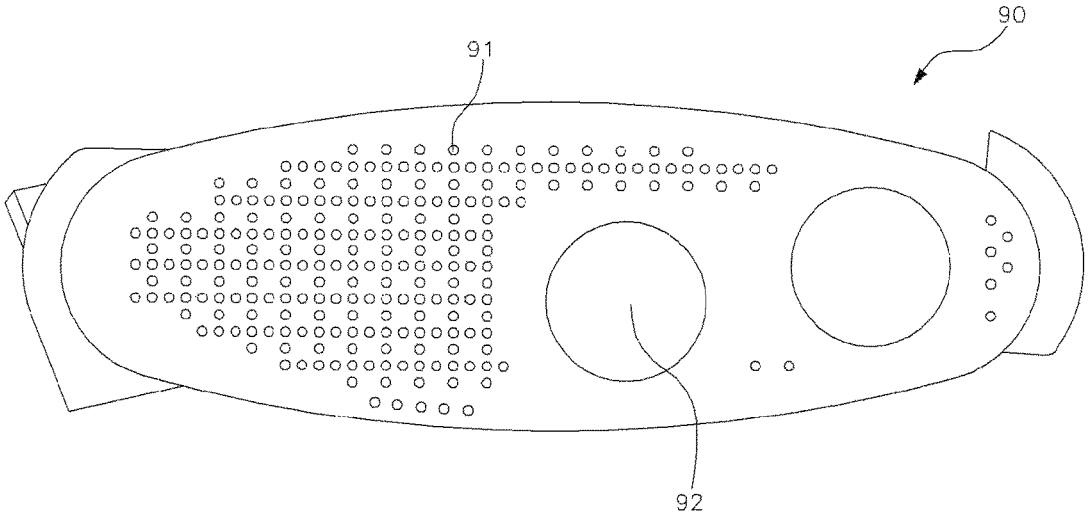
FIG. 3A is a view illustrating a front appearance of a first baffle.
Figure 3B:
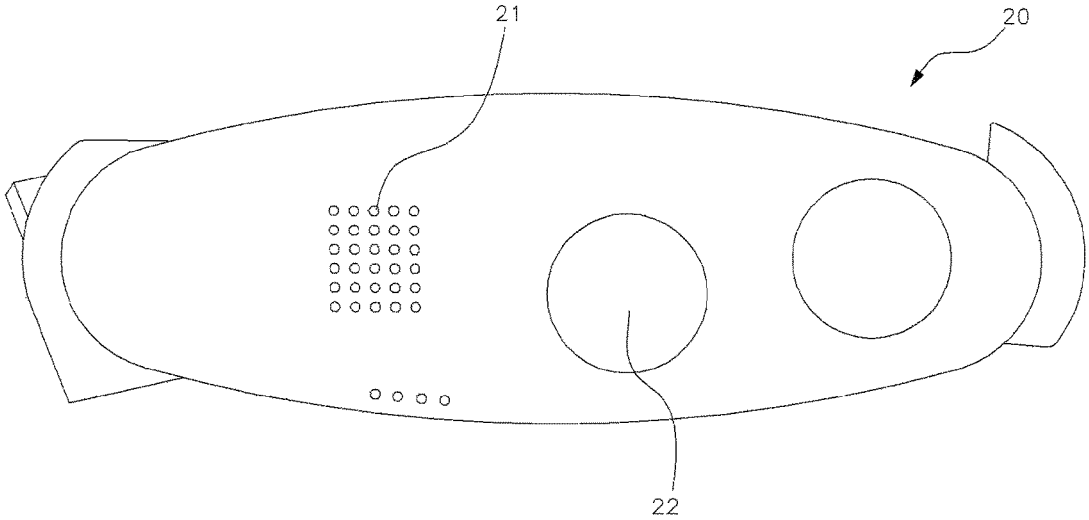
FIG. 3B is a view illustrating a front appearance of a second baffle.

A third baffle 30, which divides the front chamber 10*f* into a first chamber 10*a* and a second chamber 10*b*, is additionally mounted, and likewise, a fourth baffle 40, which divides the rear chamber 10*r* into a third chamber 10*c* and a fourth chamber 10*d*, is additionally mounted. The first to fourth baffles 10*a* to 10*d* have a plate shape formed with holes 92 and 22 into which the discharge pipes 50 may be inserted, and have a plurality of communication holes 91 and 21 formed to allow exhaust gas to flow into and out of the chambers. The third baffle 30 and the fourth baffle 40 have the same number of communication holes 91 as the first baffle 90, but as illustrated in FIG. 3A and FIG. 3B, in the exemplary embodiment of the present invention, the number of communication holes 21 formed in the second baffle 20 is smaller than the number of communication holes 91 formed in the first baffle 90.

Ends of the discharge pipes 50 positioned in the rear chamber 10*r* are blocked by caps 53, and the front chamber 10*f* and the rear chamber 10*r* (i.e., the first to fourth chambers) are filled with acoustic absorbents 70. However, in some instances, one or more of the first to fourth chambers 10*a* to 10*d* may not be filled with the acoustic absorbent so as to be used as a resonant chamber, and in the exemplary embodiment of the present invention, glass wool is used as the acoustic absorbent 70.

As illustrated, inlet holes 51 into which exhaust gas flows are formed in the discharge pipe 50 in a section where the discharge pipe 50 is positioned in the intermediate chamber 10*m*, and through holes 52 through which exhaust gas flows in and out are formed in the discharge pipe 50 in a section where the discharge pipe 50 is positioned in the front chamber 10*f* and a section where the discharge pipe 50 is positioned in the rear chamber 10*r*.

Figure 6:
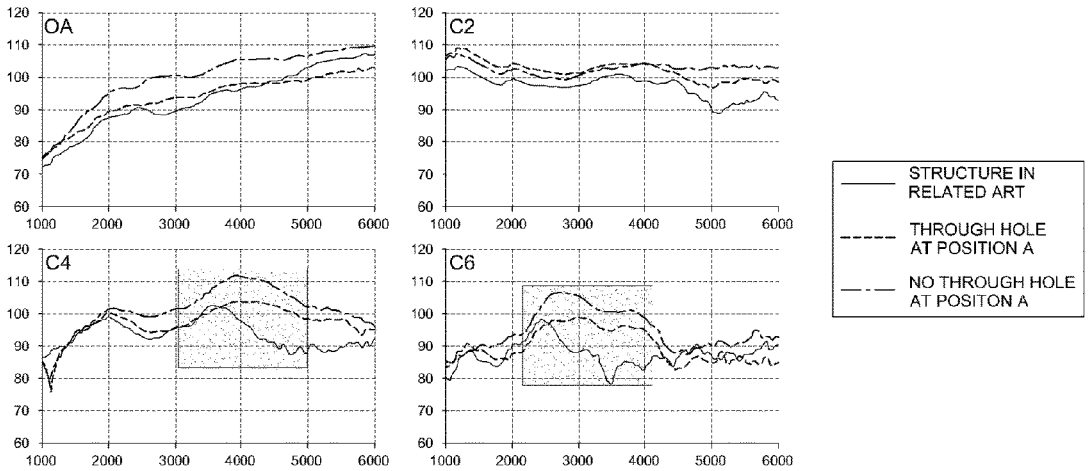
FIG. 6 is a view illustrating graphs showing results of analyzing exhaust sound using an order analysis method.

The through holes 52 have a smaller inner diameter than the inlet hole 51, and are formed to have a uniform size around the discharge pipe 50. The through holes 52 are selectively formed at the positions where the discharge pipes 50 communicate with the first to fourth chambers 10*a* to 10*d*, respectively. For example, in order to tune exhaust sound, the through holes 52 may be formed or may not be formed in portions indicated by A in FIG. 2 (and/or other portions). That is, tone implemented by the muffler may be changed in accordance with the selected positions of the through holes 52 and whether the through holes 52 are formed as illustrated in FIG. 6.

An operating state of the structure of the muffler according to the present invention, which has the aforementioned configuration, will be described in more detail. When exhaust gas flows into the intermediate chamber 10*m* through the inlet pipe 60, the exhaust gas flows into the discharge pipe 50 through the inlet holes 51.

Figure 4:
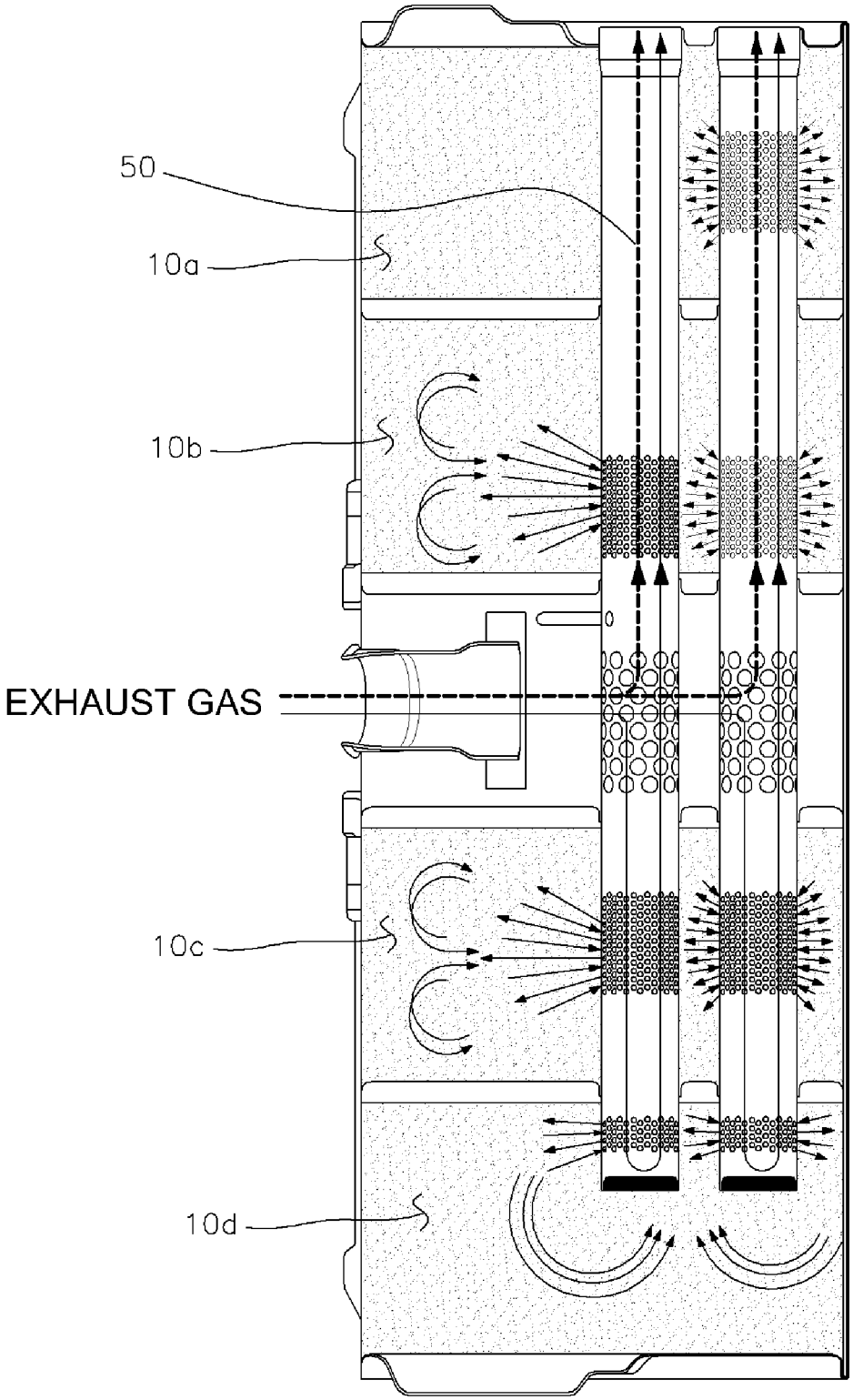
FIG. 4 is a view illustrating flow paths of exhaust gas in the muffler according to the exemplary embodiment of the present invention by arrows.
Figure 5:
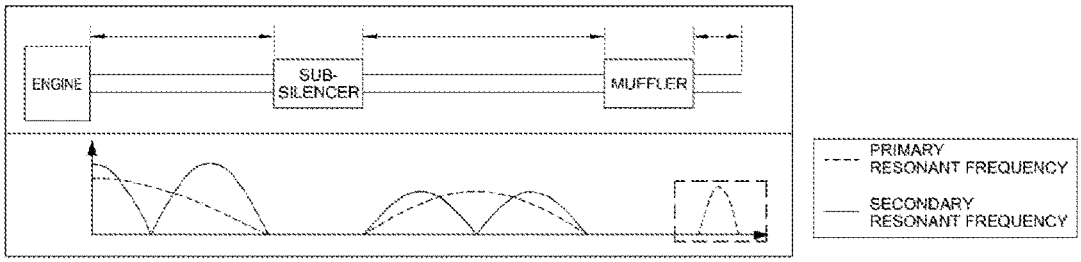
FIG. 5 is a view illustrating a state in which resonant frequencies are reduced due to resonance in air column while exhaust gas passes through a sub-silencer and the muffler according to the present invention from an engine.

In this case, as illustrated in FIG. 4, the exhaust gas is divided and then flows through the front chamber 10*f* and the rear chamber 10*r*. The exhaust gas flowing into the rear chamber 10*r* is blocked by the cap 53, and thus returns back to the front chamber 10*f* by being reflected by the cap 53, and the exhaust gas flows into and out of the first to fourth chambers 10*a* to 10*d* through the through holes 52 (and the communication holes) while the exhaust gas flows through the rear chamber 10*r* and the front chamber 10*f*, and as a result, exhaust noise in a high frequency region is reduced by the acoustic absorbents 70.

The fact that the exhaust gas is blocked by the cap 53 and returns back has the same effect as the increased flow path of exhaust gas, that is, the same effect as the increased length of the discharge pipe. That is, the effect of resonance in the air column is increased, and as a result, exhaust sound tuning may be more variously carried out through repeated experiments and tuning (such as changes in length and diameter of the discharge pipe and/or changes in size and number of through holes).

In the exemplary embodiment of the present invention, the number of communication holes 21 of the second baffle 20 is smaller than the number of communication holes 91 of the first baffle 90 so as to guide a main flow of exhaust gas so that the main flow of exhaust gas is not directed toward the rear chamber 10*r*, and as a result, it is possible to enhance discharge sound, but the number of communication holes may be set contrary to that described above (in accordance with specifications of a vehicle) in order to reduce a discharge sound.

As described above, all of the first to fourth chambers 10*a* to 10*d*, except for the intermediate chamber 10*m*, are filled with the acoustic absorbents 70 configured as glass wool, such that high frequency rough noise is absorbed, and exhaust sound in a middle frequency band (200 to 400 Hz band) may be increased by the effect of resonance in air column (such as an effect of the increased length of the discharge pipe), and as a result, it is possible to implement more sporty exhaust sound.

That is, the present invention having the aforementioned configuration has an effect in which the length of the discharge pipe 50 of the housing 10 is increased compared to the structure in the related art (i.e., a flow distance of a main flow of exhaust gas in the housing of the muffler is similar between the structure according to the present invention and the structure in the related art, but in the structure according to the present invention, exhaust gas flows only in the discharge pipe, while the first pipe and the second pipe are disconnected in the fifth chamber 6*e* in the structure in the related art. As a result, it is possible to reduce generation of high frequency booming noise, and to implement more sporty exhaust sound by increasing frequencies in a middle to low band Meanwhile, when exhaust discharge sound components are decomposed through an order analysis method (which is a concept for non-dimensionalizing vibration components associated with a rotational speed by an inputted rotational speed which causes a change in frequency), it can be seen that as illustrated in FIG. 6, the muffler according to the present invention reduces rough noise in a high frequency band compared to the structure in the related art structure, enhances sporty sound in a band of 200 to 400 Hz (2000 to 4000 RPM at C6), and an exhaust sound tone may be changed in accordance with the selected positions of the through holes and whether the through holes are formed (comparison between red lines indicating when the through holes are formed at part A and blue lines indicating when no through hole is formed at part A) (for reference, a component C2 of exhaust sound contributes to sporty sound quality because booming is increased when the vehicle accelerates due to a reduction in back pressure caused by an increase in booming component in the entire RPM region, a component C4 of exhaust sound maximizes sporty sound quality by increasing exhaust sound in a 3000 to 5000 RPM band by approximately 10 dB by the effect of resonance in air column, and a component C6 of the exhaust sound enhances the sporty sound quality by increasing the exhaust sound in a 2000 to 4000 RPM band by the effect of resonance in the air column.

In the present invention, the two discharge pipes 50 are disposed in parallel, and as a result, the present invention is advantageous in that flow resistance of exhaust gas is reduced and back pressure is reduced. Further, the front chamber 10*f* and the rear chamber 10*r*, except for the intermediate chamber 10*m*, are filled with glass wool which is the acoustic absorbent 70, and the glass wool provides a heat radiating function, and as a result, it is possible to prevent thermal damage to components at the periphery of the housing 10 of the muffler. In addition, in the present invention, the plurality of baffles is disposed in the housing 10 so as to be spaced apart from each other, and as a result, it is possible to further improve rigidity.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "interior", "exterior", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings.

The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A structure of a muffler, comprising:

a housing which has a space therein, and has a first side connected to an inlet pipe into which exhaust gas flows;

a first baffle which divides an interior of the housing into a front chamber and an intermediate chamber connected to the inlet pipe;

a second baffle which divides the interior of the housing into a rear chamber and the intermediate chamber connected to the inlet pipe; and a discharge pipe which is mounted to penetrate the first baffle and the second baffle, and mounted such that a first end of the discharge pipe is positioned in the rear chamber, and a second end of the discharge pipe extends through the front chamber and penetrates the housing, wherein at least one of the front chamber and the rear chamber is filled with an acoustic absorbent, inlet holes into which exhaust gas flows are formed in the discharge pipe in a section where the discharge pipe is positioned in the intermediate chamber, and through holes through which exhaust gas flows in and out are formed in the discharge pipe in a section where the discharge pipe is positioned in the front chamber and a section where the discharge pipe is positioned in the rear chamber, wherein a number of communication holes formed in the first baffle is larger than a number of communication holes formed in the second baffle, and wherein the first end of the discharge pipe, which is positioned in the rear chamber, is blocked by a cap.

2. The structure of claim 1, wherein two discharge pipes are disposed in parallel.

3. The structure of claim 1, wherein the discharge pipe is mounted such that a length of the section where the discharge pipe is positioned in the front chamber is longer than a length of the section where the discharge pipe is positioned in the rear chamber.

4. The structure of claim 1, wherein the acoustic absorbent is glass wool.

5. The structure of claim 1, wherein a third baffle, which divides the front chamber into a first chamber and a second chamber, is additionally mounted.

6. The structure of claim 5, wherein the through holes are formed at positions where the discharge pipe fluidicaily-communicates with the first chamber and the second chamber.

7. The structure of claim 1, wherein a fourth baffle, which divides the rear chamber into a third chamber and a fourth chamber, is additionally mounted.

8. The structure of claim 7, wherein the through holes are formed at positions where the discharge pipe fluidly-communicates with the third chamber and the fourth chamber.

9. The structure of claim 1, wherein the through holes have a smaller inner diameter than the inlet hole.

10. The structure of claim 1, wherein the through holes are formed to have a uniform size around the discharge pipe.

11. The structure of claim 1, wherein the housing is formed to have a polyhedral shape having two relatively longer sides and two relatively shorter sides, the inlet pipe is configured to penetrate one of the relatively longer sides in a direction perpendicular to the relatively longer side, and the discharge pipe is configured to penetrate one of the relatively shorter sides in a direction perpendicular to the relatively shorter side.

* * * * *